US008616629B2

(12) United States Patent
Jonsson et al.

(10) Patent No.: US 8,616,629 B2
(45) Date of Patent: Dec. 31, 2013

(54) SEATING APPARATUS

(75) Inventors: Ingemar Jonsson, Oxfordshire (GB); Shin Azumi, London (GB); Tomoko Azumi, London (GB)

(73) Assignee: Charles Keen, Oxford (GB)

( * ) Notice: Subject to any disclaimer, the term of this patent is extended or adjusted under 35 U.S.C. 154(b) by 1894 days.

(21) Appl. No.: 10/542,699

(22) PCT Filed: Jan. 19, 2004

(86) PCT No.: PCT/GB2004/000205

§ 371 (c)(1),
(2), (4) Date: Sep. 21, 2006

(87) PCT Pub. No.: WO2004/064575

PCT Pub. Date: Aug. 5, 2004

(65) Prior Publication Data

US 2007/0138843 A1 Jun. 21, 2007

(30) Foreign Application Priority Data

Jan. 20, 2003 (GB) ..... 0301227.5

(51) Int. Cl.
*A47B 39/00* (2006.01)

(52) U.S. Cl.
USPC ..... 297/174 R; 297/241; 297/171; 297/172

(58) Field of Classification Search
USPC ..... 297/170, 171, 172, 174 R, 240, 241; 248/461, 425, 371, 161; 108/65, 93, 108/90, 144.11
See application file for complete search history.

(56) References Cited

U.S. PATENT DOCUMENTS

| | | | | | |
|---|---|---|---|---|---|
| 367,037 | A | | 7/1887 | Gough et al. | |
| 1,023,620 | A | * | 4/1912 | Burge | 248/596 |
| 1,195,626 | A | | 8/1916 | Thum | |
| 1,454,656 | A | * | 5/1923 | Rork et. al. | 209/169 |
| 1,929,551 | A | * | 10/1933 | Hamilton | 312/284 |
| 2,023,761 | A | | 12/1935 | Drummey | |
| 2,204,045 | A | | 12/1935 | Johnson | |
| 2,716,440 | A | * | 8/1955 | Silverman | 297/172 |
| 3,007,425 | A | * | 11/1961 | Darandik | 112/25 |
| 3,186,761 | A | | 6/1965 | Probst | |
| 3,366,415 | A | * | 1/1968 | Cooper | 297/158.3 |
| 3,391,474 | A | * | 7/1968 | Hays, Jr. | 198/341.08 |
| 3,690,608 | A | * | 9/1972 | Poizner | 248/371 |
| 3,770,334 | A | | 11/1973 | Weber | |
| 4,134,614 | A | * | 1/1979 | Fielding, Sr. | 297/156 |

(Continued)

*Primary Examiner* — David Dunn
*Assistant Examiner* — Erika Garrett
(74) *Attorney, Agent, or Firm* — Novak Druce Connolly Bove + Quigg LLP

(57) ABSTRACT

The present invention relates to a seating apparatus, and more particularly to a combined table and chair. We describe a seating apparatus comprising a table (25), a chair (26) and a table base (16) wherein the table comprises a table top (10) and a table leg (11) defining an axis about which axis said table top is rotatable with respect to the table base; wherein the chair is mounted for rotation with said table top about said axis. In a preferred embodiment, the chair comprises a seat (21) and a chair frame (31) upon which the seat is mounted, wherein the frame includes at least one floor-engaging leg (22). Preferably, the table leg has upper and lower ends, the lower end being mounted for rotation upon the table base and the chair frame is mounted upon the table leg at a point intermediate the upper and lower ends thereof. More preferably, the chair frame is mounted substantially adjacent the lower end of the table leg.

26 Claims, 6 Drawing Sheets

(56) References Cited

U.S. PATENT DOCUMENTS

| | | | | | |
|---|---|---|---|---|---|
| 4,181,281 | A | | 1/1980 | Kosak | |
| 4,400,032 | A | * | 8/1983 | dePolo | 297/344.24 |
| 4,625,657 | A | * | 12/1986 | Little et al. | 108/93 |
| 4,662,679 | A | | 5/1987 | Franck et al. | |
| 4,679,509 | A | * | 7/1987 | Sampson, Jr. | 108/27 |
| 5,149,900 | A | * | 9/1992 | Buck | 42/94 |
| 5,458,070 | A | * | 10/1995 | Gamba et al. | 108/66 |
| 5,711,572 | A | * | 1/1998 | Khan | 297/140 |
| 5,927,835 | A | | 7/1999 | Mergold et al. | |
| 5,957,529 | A | * | 9/1999 | Schrewe | 297/232 |
| 6,058,641 | A | * | 5/2000 | Vecqueray | 42/94 |
| 6,375,256 | B1 | * | 4/2002 | Rais | 297/157.1 |
| D462,206 | S | | 9/2002 | Dame et al. | |
| D463,256 | S | | 9/2002 | Dame et al. | |
| D465,440 | S | * | 11/2002 | Ventrola et al. | D12/130 |
| D484,709 | S | | 1/2004 | Cronk et al. | |
| 7,059,670 | B2 | * | 6/2006 | Mills et al. | 297/174 R |
| 7,201,353 | B1 | * | 4/2007 | Freeman | 248/161 |
| 2003/0222487 | A1 | | 12/2003 | Cronk et al. | |

* cited by examiner

SEATING APPARATUS

The present invention relates to a seating apparatus, and more particularly to a combined table and chair.

Conventionally, seating arrangements are provided as a separate table and chair. It is known to combine a chair and table, as shown in WO99/34706, for example. This arrangement, however, possesses many of the disadvantages of a conventional table and chair. For example, it is difficult to transport the arrangement, and the user is restricted to facing in one direction.

FR-2 781 656 describes an alternative arrangement for a table having a single central table leg or post. Mounted for rotation about the post is an articulated arm having a seat rotatably mounted at the remote end thereof. However, the table can become unbalanced. Additionally as the seat is rotated about the post, it also rotates about the table. Accordingly, a person sat working at the table has to move their work around the table as they move the seat.

The present invention seeks to overcome these problems and provide a more versatile seating arrangement.

According to the present invention there is provided a seating apparatus comprising a table or other surface, a chair and a table base wherein the table comprises a table top and a table leg defining an axis about which axis said table top is rotatable with respect to the table base; wherein the chair is mounted for rotation with said table top about said axis.

In a preferred embodiment, the chair comprises a seat and a chair frame upon which the seat is mounted, wherein the frame includes at least one floor-engaging leg. Preferably, the table leg has upper and lower ends, the lower end being mounted for rotation upon the table base and the chair frame is mounted upon the table leg at a point intermediate the upper and lower ends thereof. More preferably, the chair frame is mounted substantially adjacent the lower end of the table leg.

Alternatively, the table top is mounted for rotation about the upper end of said leg and said chair frame is mounted upon said table top.

Advantageously, each seat frame floor-engaging leg includes means for allowing easy movement across the floor, such as a castor or a glide.

Preferably, the chair is connected to the table leg such that rotation of the chair about the axis of the table leg causes rotation of the table leg. Advantageously, the table top is fixed to the table leg such that rotation of the chair also rotates the table top.

In a preferred embodiment, the table base comprises a lower plate and an upper plate and an intermediate glide disk, and wherein the upper plate is fixed to the table leg. Suitably, the table base is removably secured to the table leg, for example by means of a threaded bolt arrangement. Preferably, the glide disc is made from nylon. More preferably, the glide disc further comprises raised or domed portions to allow for smooth rotation of the upper plate by reducing the surface area in contact with the upper plate.

In an alternative embodiment, the base comprises an upper concave plate having a rim, and a lower plate having a track corresponding to the rim of the upper plate. The base may alternatively comprise rotation means such as ball bearings.

Advantageously, the seat is rotatable about the vertical axis of the chair frame.

Optionally, the height of the seat is adjustable. Suitably, this may be achieved by means of a gas action strut, a threaded bolt or an electrical motor. Similarly, the height of the table may be adjustable, suitably by similar means.

In one embodiment, the table top is tiltable from its horizontal axis. Suitably, the table top is tilted by means of the rotation of a wheel having cogs located on the underside of the table top.

Optionally, the table top is slidable with respect to the table leg. In one arrangement, this can be achieved by means of a glide disc, suitably of nylon, positioned between the surface of the table top and the surface of the table leg. Preferably, the table leg further comprises a plate at the point where it meets the table leg, wherein the plate comprises a plurality of apertures enabling the table top to be locked in position by means of one or more pins. In an alternative embodiment, the seat is slidable with respect to the chair frame. Suitably, this is by means of a similar glide disc and a locking plate.

In one embodiment, the table top is rotatable through 180° about the vertical axis of the table leg. Suitably, this may be by means of a gas action in the table leg, wherein the table leg is fixed off centre to the table top.

The table top may be of any shape which suits the requirements of the user. Suitably, the table top is circular.

Optionally, the table leg further comprises one or more castor legs, each having a castor.

In one embodiment, the apparatus further comprises an additional chair. Suitably, wherein the table base is fixed to the floor.

Advantageously, the table further comprises one or more storage means. In a preferred embodiment, the table top further comprises a hook on its underside, suitable for the storage of coats and bags. Preferably, the hook is also suitable for use as a handle.

A specific embodiment of the invention will now be described by way of example only and with reference to the accompanying drawings in which.

Figure 1:
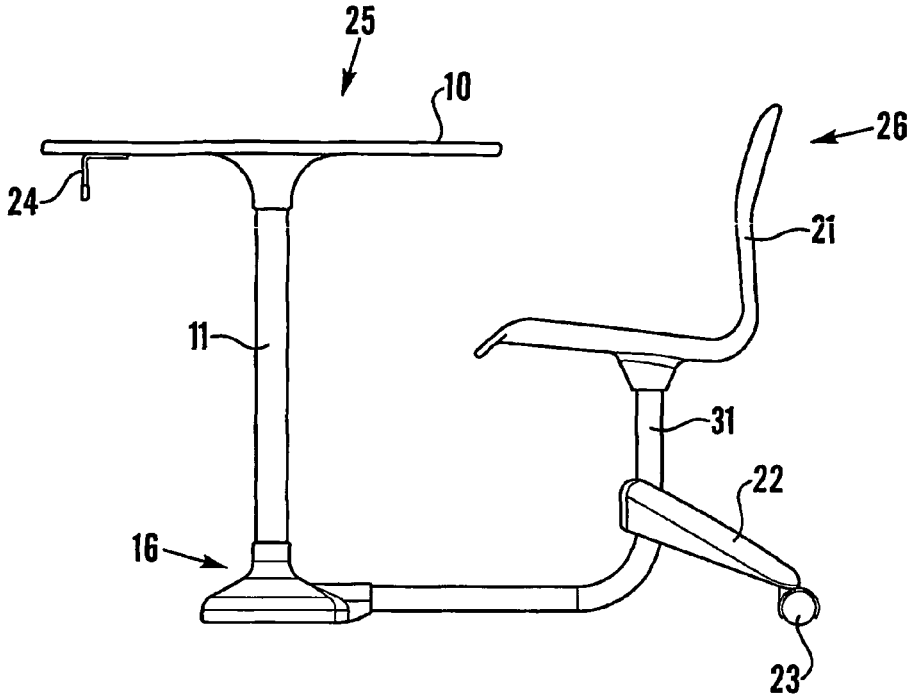
FIG. 1 is side view of an embodiment of a combined table and chair in accordance with the present invention.
Figure 2:
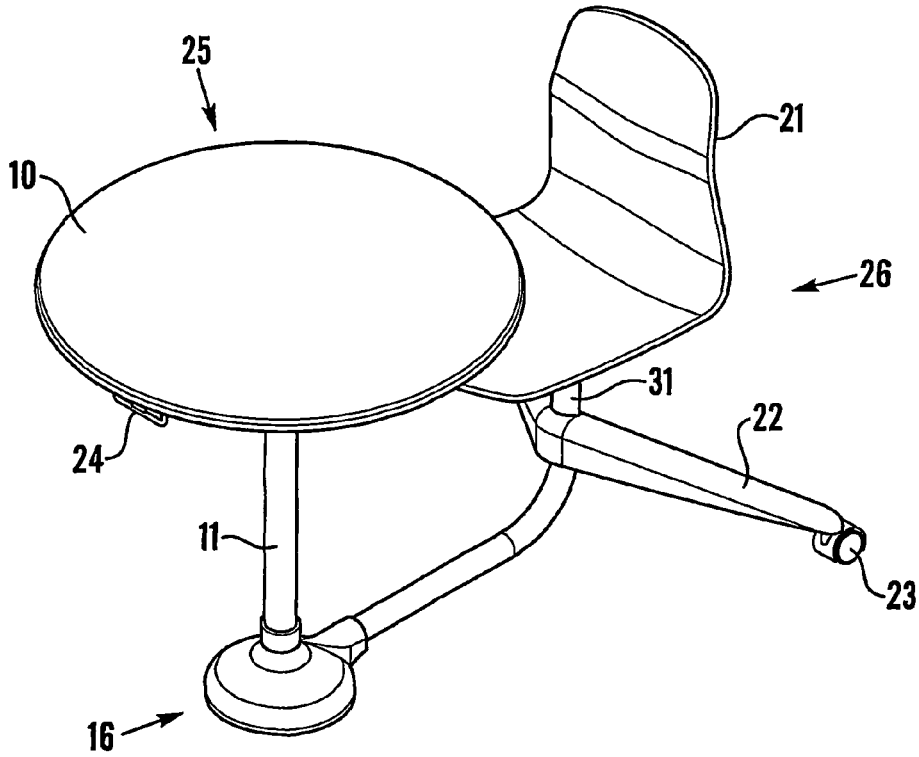
FIG. 2 is a perspective view of the embodiment of FIG. 1.
Figure 3:
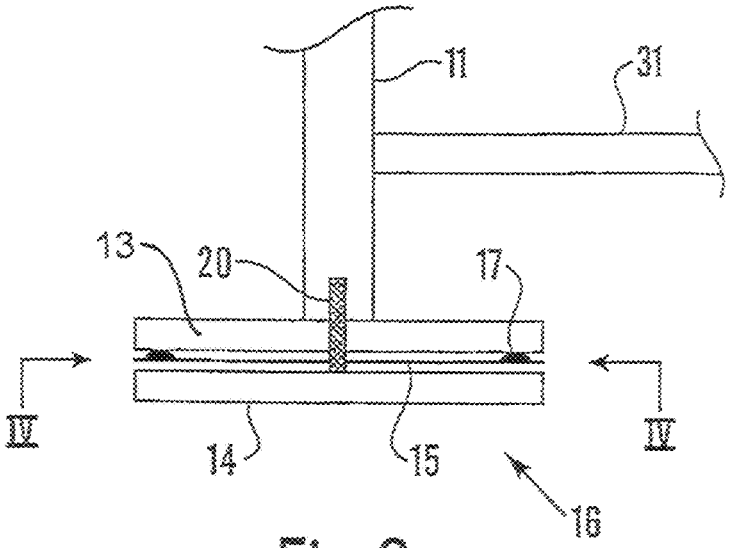
FIG. 3 is a detailed cross section of the rotation means of the embodiment of FIG. 1.

With reference to FIG. 1 there is shown a table 25 having a table top 10 supported on a table leg 11. Table 25 is supported on the ground by table base 16. As is shown in FIG. 3, table base 16 comprises an upper plate 13 and a lower plate 14. Lower plate 14 is connected to upper plate 13 and table leg 11 by means of bolt 20.

Figure 4:
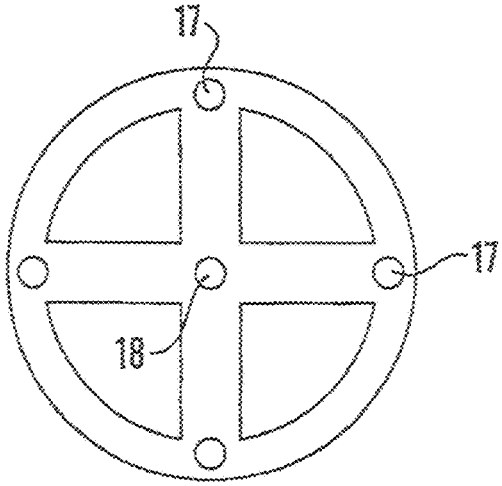
FIG. 4 is a cross-section along line IV-IV of FIG. 3.

In the embodiment shown in FIG. 1, table top 10 is fixed to table leg 11. Table top 10, table leg 11 and upper plate 13 can be rotated easily with respect to lower plate 14 by means of a glide disc 15 positioned between lower plate 14 and upper plate 13. Glide disc 15 has a central aperture 18 for receipt of bolt 20 and raised or domed portions 17 located around its circumference in order to aid smooth movement of upper plate 13, as shown in FIG. 4. Glide disk 15 is suitably made from nylon but may be made from any suitable material. Alternative arrangements enabling rotation are equally suitable. For example, assemblies including ball-races will be suitable. Lower plate 14 may be fixed to the ground by means of a bolt (not shown), for example.

Table 25 is attached to a chair 26. Chair 26 has a seat 21 and a chair frame 31. Chair frame 31 connects seat 21 to table 25 at the base of table leg 11. Chair frame 31 is supported on the ground by two castor legs 22, each having a castor 23. The arrangement of table 25 and chair 26 therefore provides that there are only three points of contact with the ground (two castors 23 and table base 16), as opposed to the 8 legs provided by a traditional separate table and chair.

Chair 26 can be rotated around the circumference of table top 10 using castors 23. Rotation of chair 26 causes the rotation of table leg 11 about its vertical axis, and hence table top 10, which is fixed to table leg 11. Hence it will be seen that Chair 26 rotates with respect to table top 10 in a manner analogous to a geostationary satellite. The apparatus therefore has the advantage that it can be positioned to face in different directions by re-positioning only the chair. This is of particular benefit when the apparatus is used as a school desk or in a conference room, for example. When in use, the weight of the user in seat 21 prevents movement of castors 23, making chair 26 secure. Alternatively or additionally the castors may include a braking arrangement to ensure that rotation is prevented upon application of only a small force downward. The table leg 11 may also include such an arrangement.

Figure 7A:
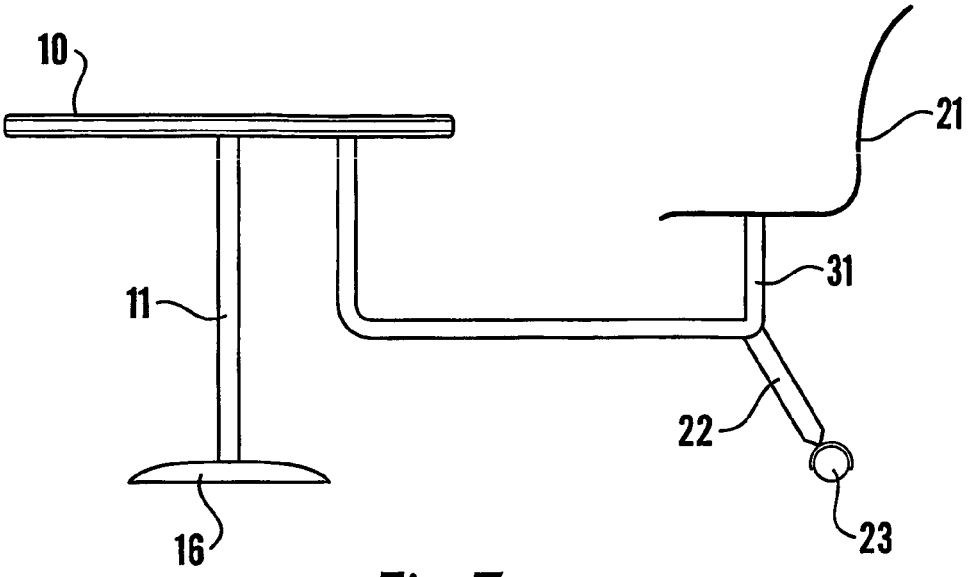
FIG. 7 is a cross section of two alternative embodiments of a chair frame in accordance with the present invention.
Figure 7B:
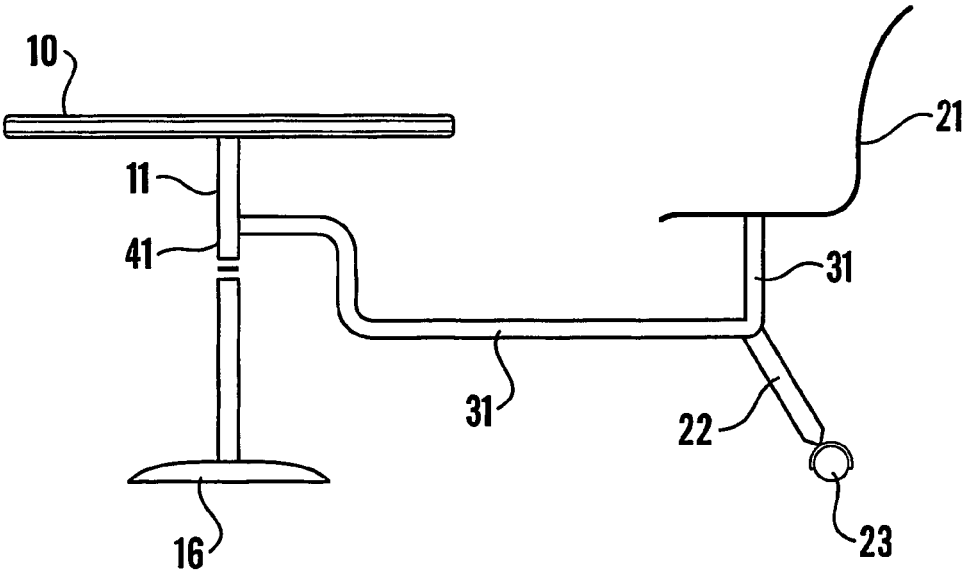

In order to illustrate more clearly the extent of the present invention, two alternative embodiments are shown in FIG. 7. In a first alternative embodiment (FIG. 7*a*), chair frame 31 connects to table 25 at table top 10. In this embodiment, table leg 11 is fixed with respect to table base 16. Table top 10 is rotatable with respect to table leg 11, and hence rotation of chair 26 causes rotation of table top 10. In the second of the alternative embodiments shown in FIG. 7*b*, chair frame 31 connects to table 25 at a point intermediate table base 16 and table top 10. In this case, an upper portion 41 of table leg 11 is rotatable with respect to a lower portion. Table top 10 is fixed to table leg 11, and the lower portion of table leg 11 is fixed to table base 16. Chair frame 31 is connected to the upper portion of table leg 11, and hence rotation of chair 26 will cause rotation of the upper portion of table leg 11 and table top 10. In both of these embodiments, rotation can be achieved by means of a glide disc, for example.

In preferred embodiments, seat 21 can rotate in a conventional manner about the vertical axis of chair frame 31 in order to enable easy access by a user to seat 21 without interference from table top 10. An additional advantage is provided in that seat 21 can be positioned in any direction, i.e. away from table top 10. Seat 21 and table top 10 are positioned such that table top 10 does not obstruct the rotation of seat 21, which can be rotated through 360°. Seat 21 may be mounted eccentrically with respect to the frame 31 such that the risk of trapping the user's fingers as the chair is rotated is reduced.

The height of seat 21 is adjustable by means of a gas action (not shown) in order to provide for users of different heights. In a modification, the frame 31 may form the outer tube of the gas strut providing the gas action. Similarly, table 25 may be adjustable by means of a gas action (not shown).

Figure 5:
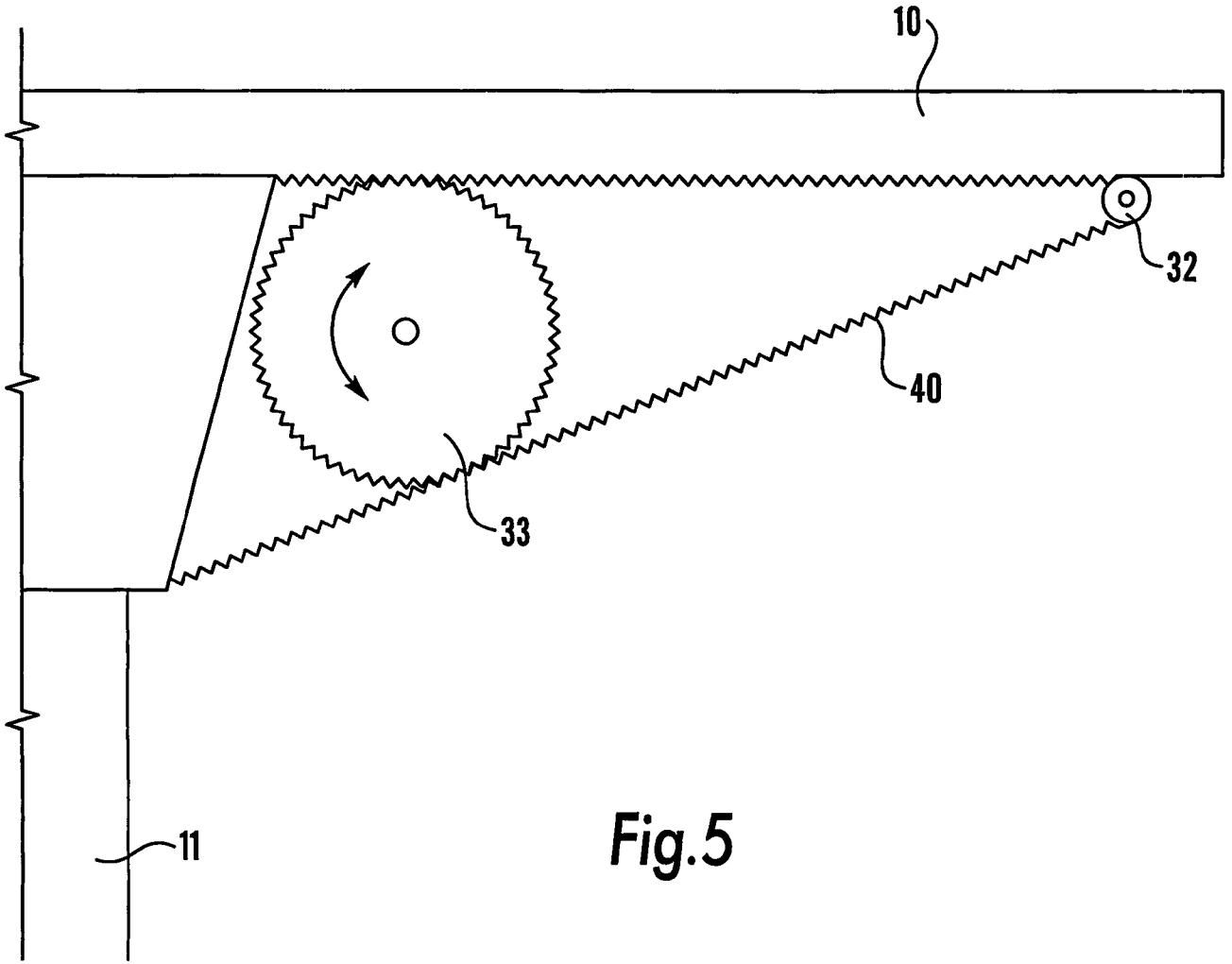
FIG. 5 is cross section of the tilt mechanism of an embodiment of a combined chair and table of the present invention.

In the embodiment of FIG. 5, table top 10 is not permanently fixed to table leg 11. Table top 10 can be tilted away from its horizontal axis in order to provide for the requirements of the user. With reference to FIG. 5, there is shown a table top 10 having a hinge 32 positioned close to the outer edge of table top 10. Hinge 32 engages table top 10 and a bar 40. Both the underside of table top 10 and bar 40 have teeth which engage a cog 33. Cog 33 is positioned close to where table top 10 meets table leg 11. Rotation of cog 33 in a clockwise direction causes its movement towards hinge 32 by engaging the teeth of table top 10 and bar 40. This movement raises the edge of table top 10 remote hinge 32. Reversing the process will lower the table top to its original position.

Figure 6:
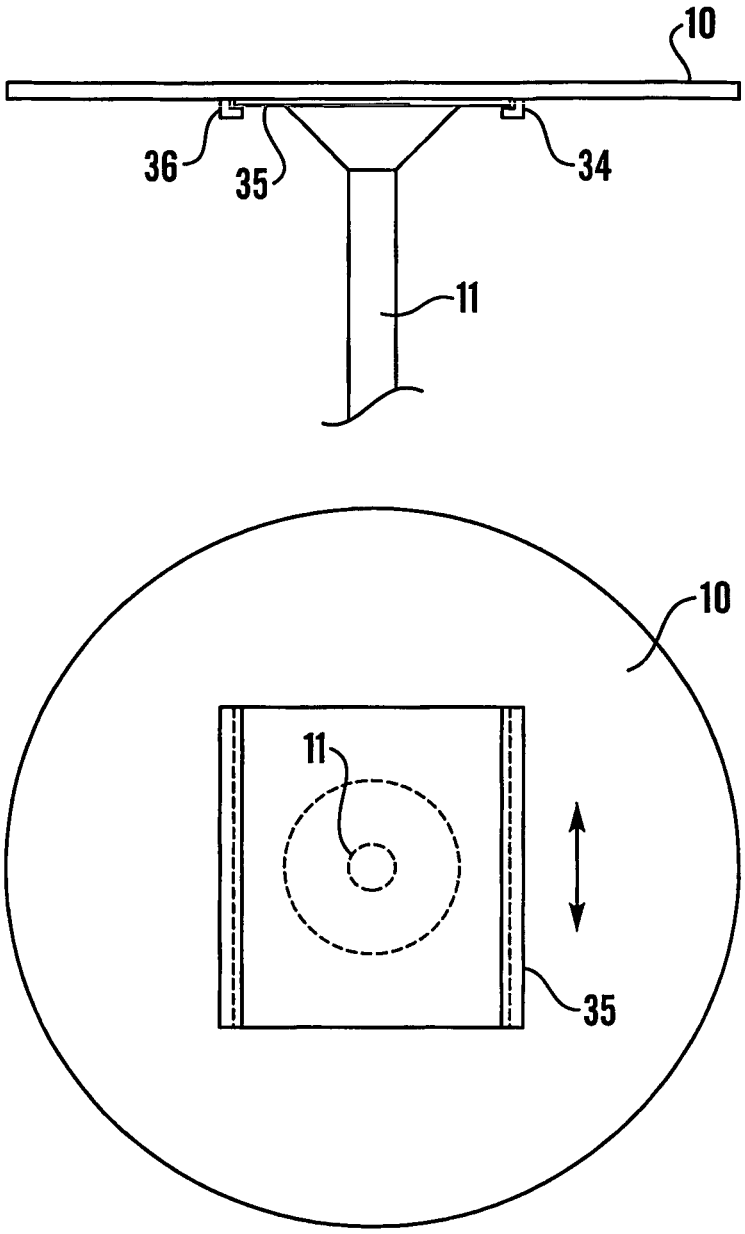
FIG. 6 is a cross section of an adjusting mechanism of an embodiment of a combined chair and table of the present invention.

In the embodiment shown in FIG. 6, table top 10 is slidable with respect to table leg 11. This provides for adjusting the depth between seat 21 and table top 10. With reference to FIG. 6 there is shown a table top 10 having two runners 36 attached at its underside. Table leg 11 has a rectangular plate 35 attached to its surface where table leg 11 meets table top 10. Plate 35 contains a plurality of apertures along each long side. Runners 36 engage plate 35 hence enabling table top 10 to slide over plate 35. A nylon glide 34 is located between table top 10 and plate 35 to provide for smooth movement of table top 10. Table top 10 is secured in position by means of two pins, each engaging an aperture of plate 35.

Figure 8:
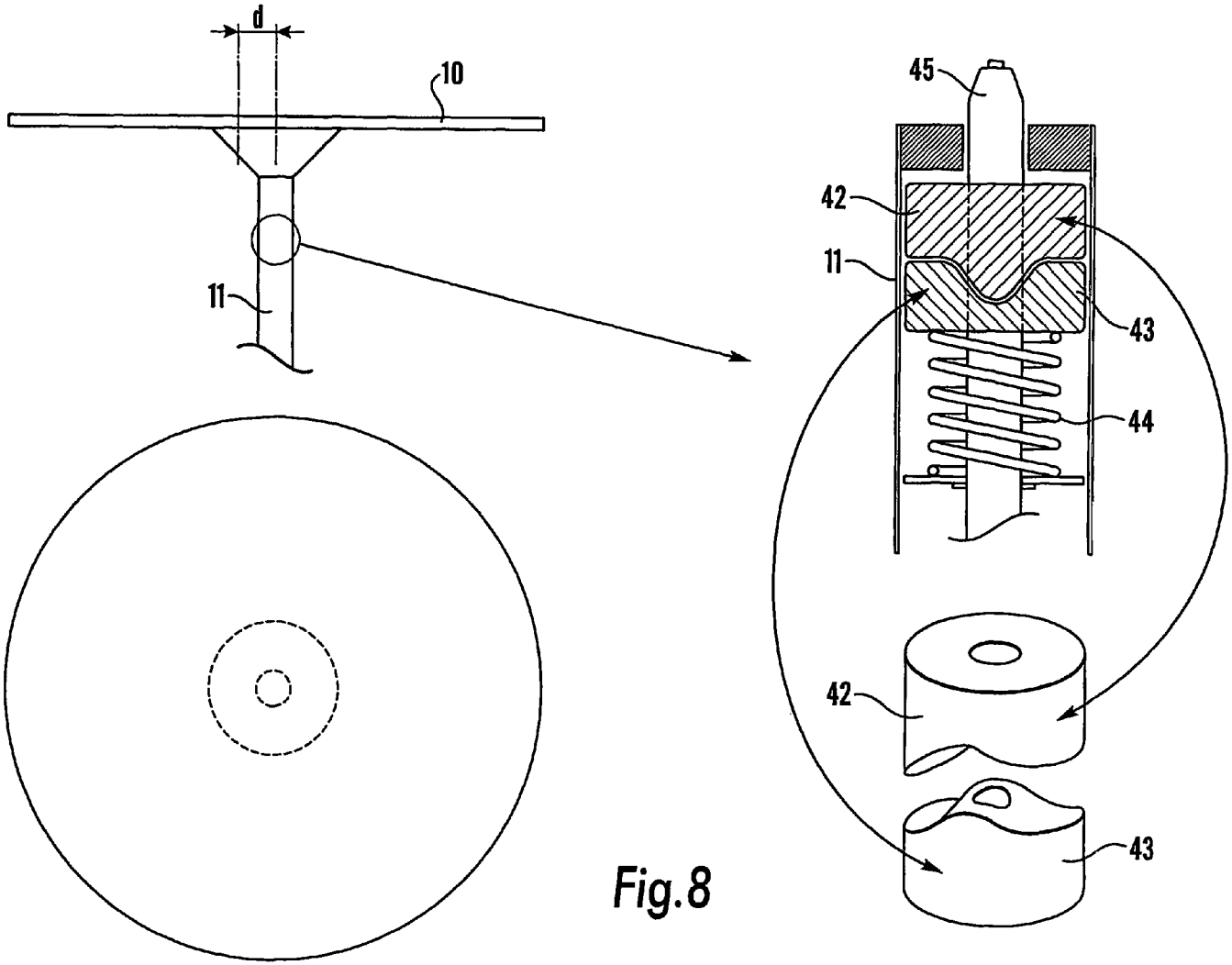
FIG. 8 is a schematic cross section of an embodiment of a table leg in accordance with the present invention.

With reference to FIG. 8, the depth between seat 21 and table top 10 may alternatively be adjusted by means of rotating table top 10, which is fixed off-centre to table top 10. With reference to FIG. 8 there is shown table leg 11 having two engaging blocks, an upper block 42, and a lower block 43, each having a central aperture, mounted above a spring 44. Table leg 11 is fixed to table top 10 at a short distance from the centre point of table top 10 by a gas action strut 45 which passes through the apertures of upper block 42 and lower block 43 within table leg 11. Table top 10 can be pulled vertically to disengage block 42 from block 43. Table top 10 can then be rotated through 180° and released thereby orienting table top 10 with its centre-point positioned in line with table leg 11. This action alters the distance of the edge of table top 10 from seat 21.

With reference to FIG. 1, table 25 also has a storage hook 24 located on the underside of table top 10. Hook 24 provides for the storage of items such as coats and bags. Hook 24 has the additional advantage that it can be used as a handle to move the apparatus. Table 25 can be lifted by hook 24, and the apparatus can be transported on castors 23.

The embodiments described above can be modified in a number of ways, all encompassed by the present invention. For example, where components are formed from injection-moulded plastics materials, additional aesthetic features can be incorporated. The apparatus may also incorporate a footrest, which may be mounted on the table leg 11 or on the chair.

In embodiments comprising a plurality of seats, the seats may be mounted at fixed respective angles, such as opposite each other at 180°, or adjacent, such as at angles of from 30° to 90°. Alternatively, the angle between adjacent seats may be variable.

The apparatus of the present invention may further include shelves above or below the table top and/or a cradle for receipt of a computer case. Indeed, in one embodiment (not shown), computer hardware, including a monitor are fully integrated into the table. In particular, the table top may constitute a housing for the hardware of a computer workstation and the input devices may be incorporated into the surface of the table top.

The apparatus of the present invention is of particular benefit in educational environments. It allows simply and rapid re-orientation of a classroom. This is particularly advantageous in the teaching of information technology and communications where conventionally students are sat at desks arranged around the edge of a room (to allow for connectivity to power supplies and network communications). However, sometimes, whole class teaching at a board at the front of the classroom may be desirable. In conventional arrangements, the students can turn their seats to face the board but are then left without a desk at which to write. The present invention overcomes such difficulties.

The invention claimed is:

1. A seating apparatus comprising a table and a single chair, wherein the table comprises a table top, a table leg and a table base and the chair comprises a seat and a chair frame on which the seat is mounted and which frame comprises at least one floor-engaging leg;

wherein said table base is provided with means for rotation of the apparatus generally about an axis defined by the table leg in response to an angular movement of the chair frame; and wherein the at least one floor-engaging leg of the chair frame is fixed with respect to the table leg and comprises means for allowing easy movement of the apparatus across the floor in response to a lifting movement of the table.

2. A seating apparatus as claimed in claim 1 wherein the table leg has upper and lower ends, the lower end being mounted for rotation upon the table base and the chair frame is mounted upon the table leg at a point intermediate the upper and lower ends thereof.

3. A seating apparatus as claimed in claim 2 wherein the chair frame is mounted substantially adjacent the lower end of the table leg.

4. A seating apparatus as claimed in claim 2 wherein the chair further comprises a chair-back.

5. A seating apparatus as claimed in claim 1 wherein the table top is mounted for rotation about the upper end of said leg and said chair frame is mounted upon said table top.

6. A seating apparatus as claimed in claim 1 wherein the means for allowing easy movement across the floor, is selected from the group consisting of castors and glides.

7. A seating apparatus as claimed in claim 6 wherein the table top is fixed to the table leg such that rotation of the chair also rotates the table top.

8. A seating apparatus as claimed in claim 7 wherein the table base is removably secured to the table leg.

9. A seating apparatus as claimed in claim 8 wherein the table base is removably secured to the table leg by means of a threaded bolt arrangement.

10. A seating apparatus as claimed in claim 6 wherein the glide is in the form of a nylon disc.

11. A seating apparatus as claimed in claim 10 wherein the glide further comprises raised or domed portions to allow for smooth rotation of the upper plate by reducing the surface area in contact with the upper plate.

12. A seating apparatus as claimed in claim 1 wherein the chair is connected to the table leg such that rotation of the chair about the axis of the table leg causes rotation of the table leg.

13. A seating apparatus as claimed in claim 1 wherein the table base comprises a lower plate and an upper plate and an intermediate glide disk, and wherein the upper plate is fixed to the table leg.

14. A seating apparatus as claimed in claim 1 wherein the base comprises rotation means.

15. A seating apparatus at claimed in claim 14 wherein the rotation means is selected from the group consisting of ball bearings and castors.

16. A seating apparatus as claimed in claim 1 wherein the seat is rotatable about the vertical axis of the chair frame.

17. A seating arrangement as claimed in claim 1 wherein the height of the seat and/or the table top is adjustable.

18. A seating apparatus as claimed in claim 1 wherein the table top is tiltable from its horizontal axis.

19. A seating apparatus as claimed in claim 1 wherein the table top is slidable with respect to the table leg.

20. A seating apparatus as claimed claim 1 wherein the seat is slidable with respect to the chair frame.

21. A seating apparatus as claimed in claim 1 in which the chair further comprises a chair-back.

22. A seating apparatus as claimed in claim 1 wherein the table leg further comprises one or more castor legs, each leg having a castor.

23. A method as claimed in claim 22 wherein the educational environment has a teaching board at a front thereof and the seating apparatus is configurable such that the chair faces the teaching board and the table of a seating apparatus is intermediate the board and its respective chair.

24. A method of configuring an educational environment such as a classroom, the method comprising providing the educational environment with a plurality of seating apparatus as claimed in claim 1.

25. A method as claimed in claim 24 wherein the educational environment is a room having an edge and the seating apparatus is configurable such that the table is arranged around the edge of the room with the chair facing the edge of the room.

26. A method as claimed in claim 24 wherein the seating apparatus is configurable between first and second positions in which the configurations of the sating apparatus with respect to the education environment are re-orientated.

* * * * *